US006134934A

United States Patent [19]

Moser et al.

[11] Patent Number: 6,134,934

[45] Date of Patent: Oct. 24, 2000

[54] PROCESS AND DEVICE FOR REVERSE ROLLING METAL STRIPS

[75] Inventors: Friedrich Moser, St. Florian; Gerhard Finstermann, Linz, both of Austria

[73] Assignee: Voest-Alpine Industrieanlagenbau GmbH, Linz, Austria

[21] Appl. No.: 09/117,511

[22] PCT Filed: Jan. 30, 1996

[86] PCT No.: PCT/AT97/00014

§ 371 Date: Jul. 31, 1998

§ 102(e) Date: Jul. 31, 1998

[87] PCT Pub. No.: WO97/27952

PCT Pub. Date: Aug. 7, 1997

[30] Foreign Application Priority Data

Mar. 31, 1996 [AT] Austria ..... A 179/96

[51] Int. Cl.[7] ..... B21B 27/06; B21B 41/06

[52] U.S. Cl. ..... 72/202; 29/527.7; 72/229

[58] Field of Search ..... 72/200, 202, 229, 72/365.2, 366.2; 29/527.7

[56] References Cited

U.S. PATENT DOCUMENTS

| | | | |
|---|---|---|---|
| 2,658,741 | 11/1953 | Schmidt et al. . | |
| 4,465,912 | 8/1984 | Brettbacher et al. | 219/10.49 |
| 4,522,050 | 6/1985 | Thomas | 72/229 |

FOREIGN PATENT DOCUMENTS

| | | | |
|---|---|---|---|
| 0321733 | 6/1989 | European Pat. Off. . | |
| 0619377 | 10/1994 | European Pat. Off. . | |
| 177747 | 2/1954 | Germany . | |
| 1158024 | 11/1963 | Germany . | |
| 2900648 | 4/1980 | Germany . | |
| 3816469 | 11/1989 | Germany . | |
| 56-59507 | 5/1981 | Japan . | |
| 62-89502 | 4/1987 | Japan | 29/527.7 |
| 62-248503 | 10/1987 | Japan . | |
| 1122605 | 5/1989 | Japan . | |
| 1127105 | 5/1989 | Japan . | |
| 237903 | 2/1990 | Japan . | |
| 537718 | 12/1976 | U.S.S.R. . | |

*Primary Examiner*—Rodney A. Butler

*Attorney, Agent, or Firm*—Birch, Stewart, Kolasch & Birch, LLP

[57] ABSTRACT

To ensure optimum temperature conditions for a strip (9, 9') in reverse rolling, two or several strips (9, 9') are rolled alternately, wherein during the rolling of one of the strips (9) in at least one rolling pass the other strip (9') or the other strips remain in a waiting position wound into a coil (12).

5 Claims, 2 Drawing Sheets

PROCESS AND DEVICE FOR REVERSE ROLLING METAL STRIPS

This application claims the benefit under 35 U.S.C. §371 of prior PCT International Application No. PCT/AT97/00014 which has an International filing date of Jan. 30, 1996 which designated the United States of America, the entire contents of which are hereby incorporated by reference.

BACKGROUND OF THE INVENTION

1. Field of the Invention

The invention relates to a process for the production of a hot-reverse-rolled strip, in particular a steel strip, wherein a strip is produced either directly by continuous casting or by continuous casting plus a subsequent roughing operation, the strip is subsequently hot-rolled in several rolling passes and after each rolling pass is wound into a coil, and a device for carrying out the process.

2. Related Art

A process of this kind is known from JP-A-2-37903.

A process for the reverse rolling of a hot strip is also described for instance in DE-A-29 00 648. With this known process, the strip after each rolling pass is picked up by a coiling means constructed as a coiler furnace. There are provided two coiler furnaces having a hot-reversing stand arranged between them; the strip as it passes back and forth is rolled in the hot-reversing stand between the coiler furnaces several times, until the strip has reached the required final thickness.

With a hot-rolling process, temperature differences between the strip ends as well as strip edges and central parts of the strip result in the course of the rolling operation. By coiling the strip, it is feasible to avoid very great temperature differences, yet equalization of temperature it is not feasible to such an extent that the strip ends or strip edges, respectively, will again exhibit a temperature which does not deviate too much from the ideal rolling temperature, since this would require a prolonged break between two successive rolling passes, i.e. the rolling operation would have to be interrupted. Insufficient utilization of the reverse rolling device as well as decrease of production would be the consequence.

SUMMARY OF THE INVENTION

The invention aims at avoiding these disadvantages and difficulties and has as its object to provide a process of the kind initially described as well as an apparatus for carrying out the process, which process and apparatus render it possible on the one hand to utilize the reverse rolling device in the best manner possible during its entire working time, i.e. to maintain a rolling operation without interruptions and without loss in terms of the amount being produced and yet to achieve optimum temperature conditions for the strip to be rolled while saving as much energy as possible, combined with the production of a strip in a continuous casting plant. Also, differences in temperature between the strip ends and the strip edges and central parts of the strip are to be kept so low as to negatively affect neither the rolling process or the rolling apparatus nor the quality of the strip.

According to the invention, this object is achieved in a process of the kind initially described, in that two or several strips are rolled alternately and during the rolling of one of the strips in at least one rolling pass the other strip or the other strips remain in a waiting position wound into a coil.

The process of the invention moreover renders it possible to achieve a lower final thicknesses, namely without additional expense of energy. Further improvement of the geometrical product tolerances (profile, thickness, flatness) can be achieved in a simple manner and without major additional expenditures. As an additional result of equalizing the temperature, the increase in the roll separating force when introducing the strip ends into the roll stand is minimized and less load is applied on the roll bearing arrangements.

From JP-A 56-59507 it is known to cold-roll electrical sheet, whereby the magnetic characteristics are to be adjusted. In particular, an aging process is to take place several times in succession, between the individual rolling passes. To that end, a strip material is reverse-rolled, wherein two strips are reverse-rolled alternately, namely such that during the rolling of one of the strips the other strip, for the purpose of aging, remains in a coiled holding position.

According to the invention, a heat equalization is suitably carried out for the strip or the strips, namely including the strip end or the strip ends, while the strip(s) is (are) in a waiting position in the form of a coil.

The process of the invention renders it possible not only to adjust optimum temperature conditions for the rolling operation, but it can also be employed to improve the properties of the strip material before or after a reduction pass, i.e. to improve the physical strip properties or fine structures of the strip by specific action of temperature, for example as a function of the thickness and quality of the rolling stock, namely in that a heat treatment, in particular heating, is carried out for the strip or the strips, namely including the strip end or the strip ends, while the strip(s) is (are) in a waiting position in the form of a coil. Hereby it also becomes feasible to bring the strip to an optimum rolling temperature; thermal energy lost in the rolling operation is supplied to the strip again.

A device for carrying out the process of the present invention, comprising a continuous casting plant, optionally a roughing stand, and comprising a strip rolling plant that is arranged downstream and has at least one reversing stand and coiling means is characterized by at least three coiling means of which at least two are provided on an entry side of the reversing stand and at least one on the other entry side of the reversing stand.

According to a preferred embodiment, two coiling means each are provided on each entry side of the reversing stand.

Advantageously, the coiling means are provided with a heat-insulating jacket. However, they could also be placed in a heated space.

Suitably, the coiling means are configured as coiler furnaces and preferably are provided with a heating means.

To save energy it is advantageous that two coiling means be jointly surrounded by an insulating jacket.

To also be able to coil the strip ends completely, the coiling means suitably is provided with a device for coiling and uncoiling the strip end.

Another preferred embodiment is characterized in that the coiling means is provided with an insulated, optionally heatable, largely closed inlet or delivery zone.

Advantageously, at least one coiling means is provided with a protective gas means.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described more fully with reference to the drawing, by means of several exemplary embodiments, wherein.

DETAILED DESCRIPTION OF THE PREFERRED EMBODIMENTS

Figure 1:
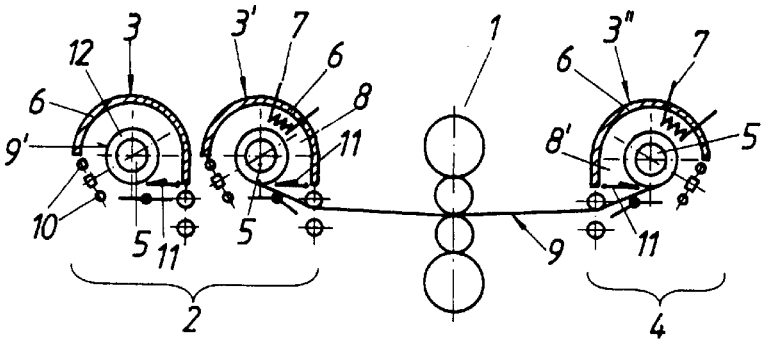
FIG. 1 depicts a schematic side view of an arrangement of an apparatus according to the invention.

FIG. 1 shows an overall arrangement of an apparatus for carrying out a reverse rolling operation comprising a reversing stand 1 that may be designed either as a roughing stand or as a finishing stand (Steckel stand). On one side 2 of the reversing stand 1 there are arranged two coiling means constructed as coiler furnaces 3 and 3'. On the other side 4 of the reversing stand 1 only a single coiling means 3", likewise designed as a coiler furnace, is provided. Instead of the single reversing stand 1 arranged between the coiler furnaces 3 to 3" there may of course also be provided a multiple stand in which a strip 9 or 9' during one pass undergoes two or several reductions per pass.

To that end, the coiler furnaces 3 to 3" have appropriate devices, such as driving rollers 10, capable of seizing the strip end and drawing it out of the respective coiler furnace 3 to 3", as well as so-called coil openers 11, i.e. wedge-shaped devices adjustable relative to the wound-up coil 12—also referred to as coil opening swords—allowing the strip end to be disengaged from the coil 12 and guided out of an interior 8 of each coiler furnace 3 to 3". For adjusting a coil opener 11 relative to the coil surface of a coil 12 that has been coiled on a coiler mandrel 5 there serve adjustment devices (not illustrated).

In case that the complete coiling of a strip including its strip end be feasible only with difficulty, a coiler furnace 3 to 3" may also be provided with an insulated, optionally heatable inlet or delivery zone which is optionally constructed so as to be pivotable, in order to move the strip and the inlet or delivery zone out of the region of the roller table.

Advantageously, protective atmospheres can be established in the interiors 8 of the coiler furnaces 3 to 3" by means of protective gas means (not illustrated), so that scaling of the strips 9, 9' can be prevented.

The function of the device is as follows:

By the device according to the invention, two strips 9, 9' can be rolled alternately. While the one strip 9 is being rolled, the other strip 9' is in a waiting position wound into a coil 12, in the second of the two coiler furnaces 3, 3' adjacently arranged on the side 2 of the reversing stand 1. While the strip 9' remains here until it is used for rolling, i.e. the other strip 9 is rolled in two or several rolling passes, equalization of temperature or a thermal treatment can be carried out, if necessary even under a protective atmosphere. As the second strip 9' is being coiled, the first rolled strip 9 is in a waiting position in the form of a coil, and can for its part be subjected to equalization of temperature for subsequent rolling passes.

Figure 2:
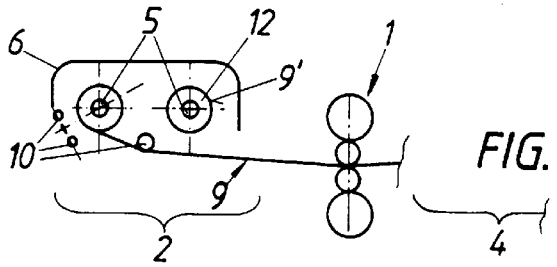
FIGS. 2 and 3 show further embodiments in an illustration analogous to FIG. 1; and In FIGS. 4 to 6 there is represented the arrangement of an apparatus, in each instance in conjunction with a continuous casting plant.
Figure 3:
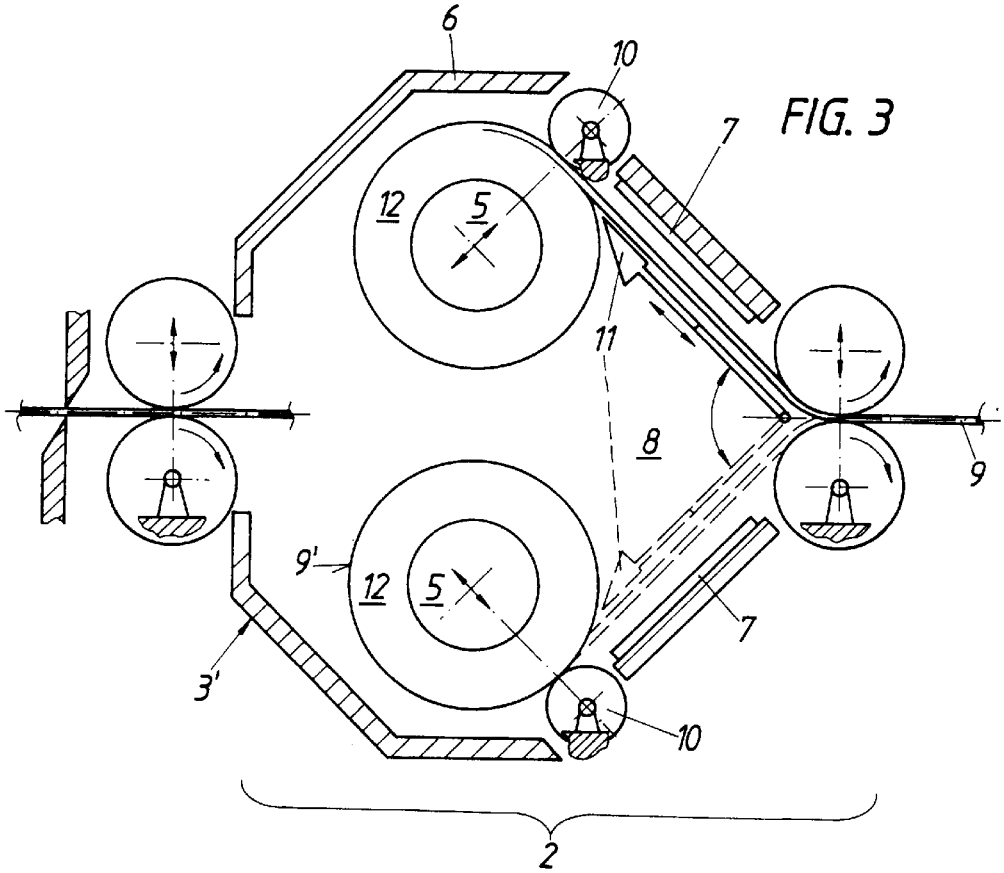

According to the embodiments represented in FIGS. 2 and 3, two coiler mandrels 5 are arranged adjacent each other and are surrounded by a common thermal-protection housing 6. According to FIG. 2, the coiler mandrels 5 are disposed in a horizontally adjacent arrangement, and according to FIG. 3 in a vertically adjacent arrangement.

Figure 4:
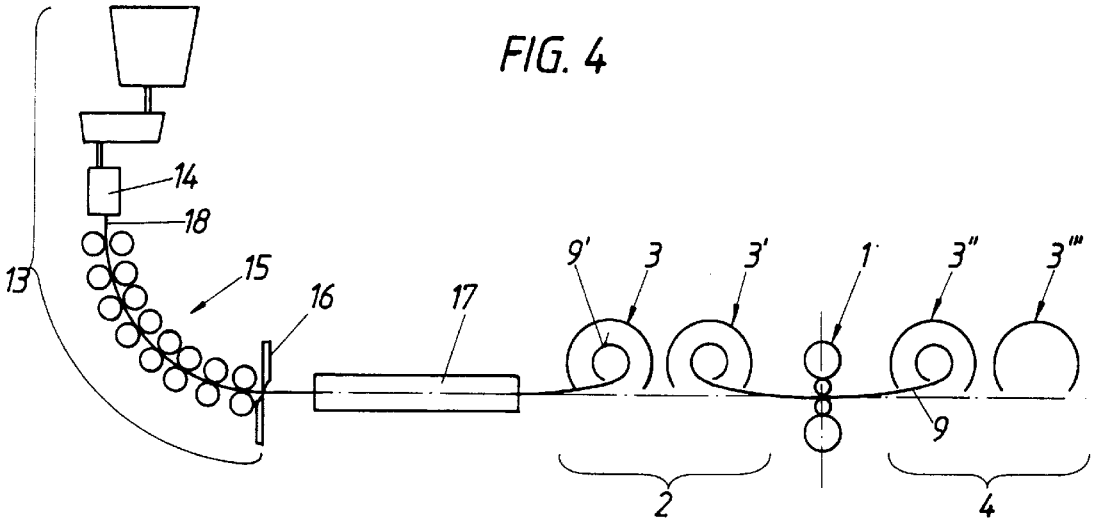
Figure 5:
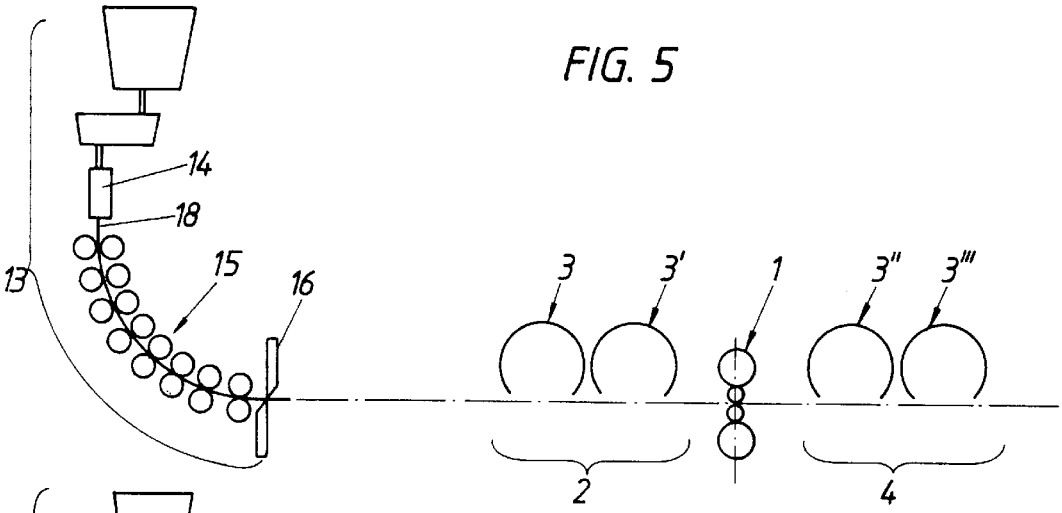
Figure 6:
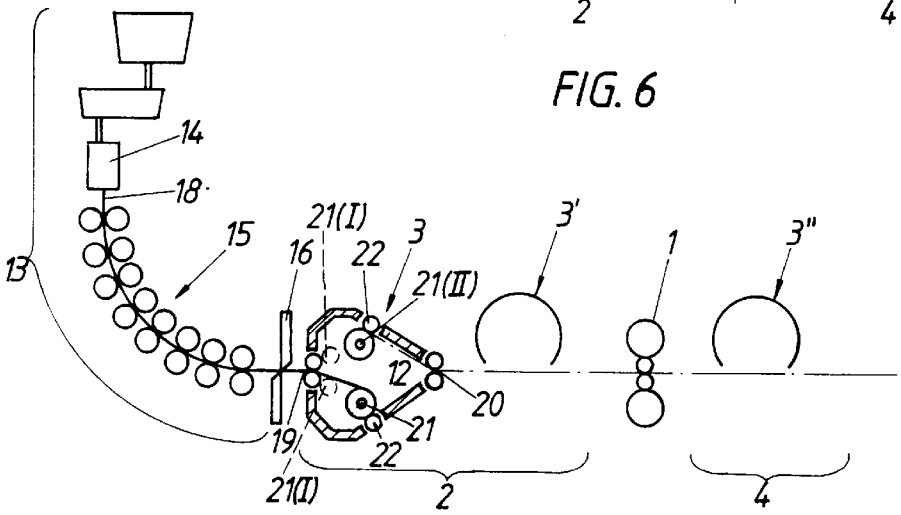

The invention can be realized with particular advantage for the production of a hot strip in conjunction with a continuous casting plant. FIGS. 4, 5 and 6 schematically represent different variants of such composite plants.

According to the embodiments represented in FIGS. 2 and 3, two coiler mandrels 5 are arranged adjacent each other and are surrounded by a common thermal-protection housing 6. According to FIG. 2, the coiler mandrels 5 are disposed in a horizontally adjacent arrangement, and according to FIG. 3 in a vertically adjacent arrangement.

FIGS. 4, 5 and 6 schematically represent different variants of continuous casting plants combined with a device for reverse rolling.

According to FIG. 4, a temperature-equalizing furnace 17 for receiving strips that have been separated from the strand is provided downstream of a continuous casting plant 13 comprising a mold 14, a roller guideway 15 and a separating means 16 connected downstream of this latter. In the case where the strand 18 as it exits the mold 14 is not thin enough to allow the coiling thereof in its completely solidified condition, there is further provided in the continuous casting plant a roughing stand (not illustrated) for rolling a strand 18 suitable for coiling. Directly in line with the continuous casting plant 13 there are provided coiling means 3 to 3"' constructed as coiler furnaces and, arranged therebetween, a reversing stand 1. Hence, in accordance with the exemplary embodiment illustrated in FIG. 4, two coiler furnaces 3, 3' and 3", 3"' each are provided on each side 2 or 4, respectively, of the reversing stand 1. There could also be more or there could be only a single coiler furnace on one of the two sides 2 and 4 of the reversing stand 1.

The function is as follows: First, a strip 9' which has been separated from the strand 18 is conveyed directly into the temperature-equalizing furnace 17, namely at a withdrawal speed considerably in excess of the continuous-casting speed. After an equalization of temperature, the strip 9' according to the process of the invention is rolled alternately with a second strip 9 previously separated from the strand 18.

Due to the method of the present invention it is feasible—as is illustrated in FIG. 5—to omit the temperature-equalizing furnace 17, since the coiler furnace 3 arranged first in the direction of strand withdrawal can take over that function without interfering with the process of the present invention for reverse rolling. In that case, at least two coiler furnaces 3, 3' and 3", 3"' each are arranged on each side 2 and 4 of the reversing stand.

FIG. 6 shows a special execution of a coiler furnace 3 arranged first in the direction of strand delivery, having a separate strip inlet opening 19 and a separate strip outlet opening 20, similar to the illustration of FIG. 3. The coiler mandrel 21 (here, two coiler mandrels 21 are provided arranged symmetrically The invention is not limited to the illustrated exemplary embodiments but may be modified in various respects. For instance, in a device according to FIG. 1 two coiler furnaces may likewise be provided on the side 4 of the reversing stand 1, whereby the possibility arises of subjecting a strip 9 or 9' to equalization of temperature or to thermal treatment even after an uneven number of rolling passes. In the case that more than two strips are to be rolled alternately, a corresponding number of coiler furnaces needs to be provided.

From the following example of a rolling schedule, the amount of time can be seen which with a device according to FIG. 1 is available for a strip 9 or 9' for thermal treatment in the case of two alternately rolled strips 9, 9'. Rolling of each strip 9, 9' is done in seven passes each, with an equalization of temperature or a residence time, respectively, which extend over two manipulation times each.

Legend:

CF 3: coiler furnace 3

CF 3': coiler furnace 3'

CF 3": coiler furnace 3"

RT strip 9: equalization of temperature or residence time for strip 9

RT strip 9': equalization of temperature or residence time for strip 9'

9 (pass i): position of strip 9 after pass No. i

9' (pass i): position of strip 9' after pass No. i

Rolling schedule

| Process step | Delivery | CF 3" | CF 3' | CF 3 | Inlet | |
|---|---|---|---|---|---|---|
| | | | | | 9 | first strip 9 |
| 1 | | 9 (pass 1) | | | | |
| 2 | | | 9 (pass 2) | | 9' | first strip 9' |
| 3 | | 9' (pass 1) | RT strip 9 | | | |
| 4 | | | RT strip 9 | 9' (pass 2) | | |
| 5 | | 9 (pass 3) | | RT strip 9' | | |
| 6 | | | 9 (pass 4) | RT strip 9' | | |
| 7 | | 9' (pass 3) | RT strip 9 | | | |
| 8 | | | RT strip 9 | 9' (pass 4) | | |
| 9 | | 9 (pass 5) | | RT strip 9' | | |
| 10 | | | 9 (pass 6) | RT strip 9' | | |
| 11 | | 9' (pass 5) | RT strip 9 | | | |
| 12 | | | RT strip 9 | 9' (pass 6) | | |
| 13 | 9 (pass 7) | | | RT strip 9' | 9 | second strip 9 |
| 14 | | 9 (pass 1) | | RT strip 9' | | |
| 15 | 9' (pass 7) | | RT strip 9 | | | |
| 16 | | | 9 (pass 2) | | 9' | second strip 9' |
| 17 | | 9' (pass 1) | | | | |
| 18 | | | | 9' (pass 2) | | |
| 19 | | 9 (pass 3) | | RT strip 9' | | |
| 20 | | | 9 (pass 4) | RT strip 9' | | |
| 21 | | 9' (pass 3) | RT strip 9 | | | |
| 22 | | | RT strip 9 | 9' (pass 4) | | |

-continued

Rolling schedule

| Process step | Delivery | CF 3" | CF 3' | CF 3 | Inlet |
|---|---|---|---|---|---|
| . | | | . | | |
| . | | | . | | |
| . | | | . | | |
| | | | and so on | | |

What is claimed is:

1. A method for the production of a plurality of hot-reverse-rolled strips wherein each of the plurality of strips is produced by either continuous casting or continues casting plus a roughing operation and then hot-rolled using a plurality of rolling passes whereby after each pass a strip is wound into a coil, the method comprising the steps of:

providing a plurality of coils for holding strip material;

providing a plurality of strip material for hot-rolling;

rolling one of said plurality of strip material while another of said plurality of strip material is wound around one of said plurality of coils, said one of said plurality of strip material undergoing at least a plurality of rolling passes while said another of said plurality of strips is in the wound position.

2. The method of claim 1, further comprising the step of:

temperature equalizing each of said plurality of strip material wound around said plurality of coils, whereby said temperature equalizing is applied to each of said plurality of strip material failing to be rolled.

3. The method of claim 1, wherein said temperature equalizing step equalizes the temperature of each of said plurality of strip material using a thermal-protection housing surrounding each of said plurality of coils.

4. The method of claim 1, wherein said rolling step rolls steel strip material.

5. The method of claim 2, wherein said temperature equalizing step equalizes the temperature of each of said plurality of strip material using heat.

* * * * *

UNITED STATES PATENT AND TRADEMARK OFFICE

CERTIFICATE OF CORRECTION

PATENT NO. : 6,134,934
DATED : October 24, 2000
INVENTOR(S) : Friedrich Moser et al.

It is certified that error appears in the above-identified patent and that said Letters Patent is hereby corrected as shown below:

Title page,
Item [22], please change the PCT filing date from "Jan. 30, 1996" to
-- Jan. 28, 1997 --.

Item [30], please change the Austrian priority date from "Mar. 31, 1996" to
-- Jan. 31, 1996 --.

Signed and Sealed this

Twenty-fifth Day of June, 2002

*Attest:*

*Attesting Officer*

JAMES E. ROGAN
*Director of the United States Patent and Trademark Office*